US006295751B1

(12) United States Patent
Piwonski

(10) Patent No.: US 6,295,751 B1
(45) Date of Patent: Oct. 2, 2001

(54) FLARE ATTACHMENT FOR A FIREARM WITH A REMOVABLE BARREL

(76) Inventor: Charles J. Piwonski, 74 Pent Rd., Beacon Falls, CT (US) 06403

( * ) Notice: Subject to any disclaimer, the term of this patent is extended or adjusted under 35 U.S.C. 154(b) by 0 days.

(21) Appl. No.: 09/580,183

(22) Filed: May 26, 2000

(51) Int. Cl.[7] ..... F41C 27/06; F41A 21/00
(52) U.S. Cl. ..... 42/1.15; 42/77; 42/75.02
(58) Field of Search ..... 42/1.15, 75.02, 42/77

(56) References Cited

U.S. PATENT DOCUMENTS

| | | | | |
|---|---|---|---|---|
| 1,788,443 | | 1/1931 | Sedgley . | |
| 2,216,022 | | 9/1940 | Pomeroy | 42/4 |
| 2,852,880 | * | 9/1958 | Kauffman . | |
| 3,044,360 | | 7/1962 | Stefan et al. | 89/1 |
| 3,665,630 | | 5/1972 | Taylor | 42/12 |
| 3,708,902 | * | 1/1973 | Foster et al. . | |
| 3,842,527 | | 10/1974 | Low | 42/75 |
| 3,921,325 | * | 11/1975 | Tennigkeit . | |
| 4,266,357 | * | 5/1981 | Greenleaf . | |
| 4,418,488 | * | 12/1983 | Hughes . | |
| 4,506,604 | * | 3/1985 | Hughes . | |
| 4,644,930 | | 2/1987 | Mainhardt | 124/58 |
| 4,648,192 | | 3/1987 | Harness | 42/77 |
| 4,711,047 | * | 12/1987 | Meller . | |
| 5,020,260 | | 6/1991 | Houghton | 42/75.02 |
| 5,148,620 | | 9/1992 | Nelson | 42/77 |
| 5,410,834 | | 5/1995 | Benton et al. | 42/75.02 |
| 6,209,250 | * | 4/2001 | Mills . | |

OTHER PUBLICATIONS

AR–7 Industries, LLC The One. The Only. The Original. product description from Internet web site: http://www.ar–7.com/rifles/riles/html dated Aug. 31, 2000, 2 pages.

* cited by examiner

*Primary Examiner*—Michael J. Carone
*Assistant Examiner*—Troy Chambers
(74) *Attorney, Agent, or Firm*—William C. Crutcher

(57) ABSTRACT

An attachment for a firearm with a removable barrel screws onto the firearm in place of the barrel and enables firing a flare. The attachment includes a firing pin housing with a sliding firing pin extension, and a flare cartridge barrel, which may be temporarily removed to receive a flare cartridge and then replaced. The normal bolt action of the firearm actuates the firing pin extension to fire the flare cartridge.

7 Claims, 2 Drawing Sheets

FLARE ATTACHMENT FOR A FIREARM WITH A REMOVABLE BARREL

BACKGROUND OF THE INVENTION

Figure 1:
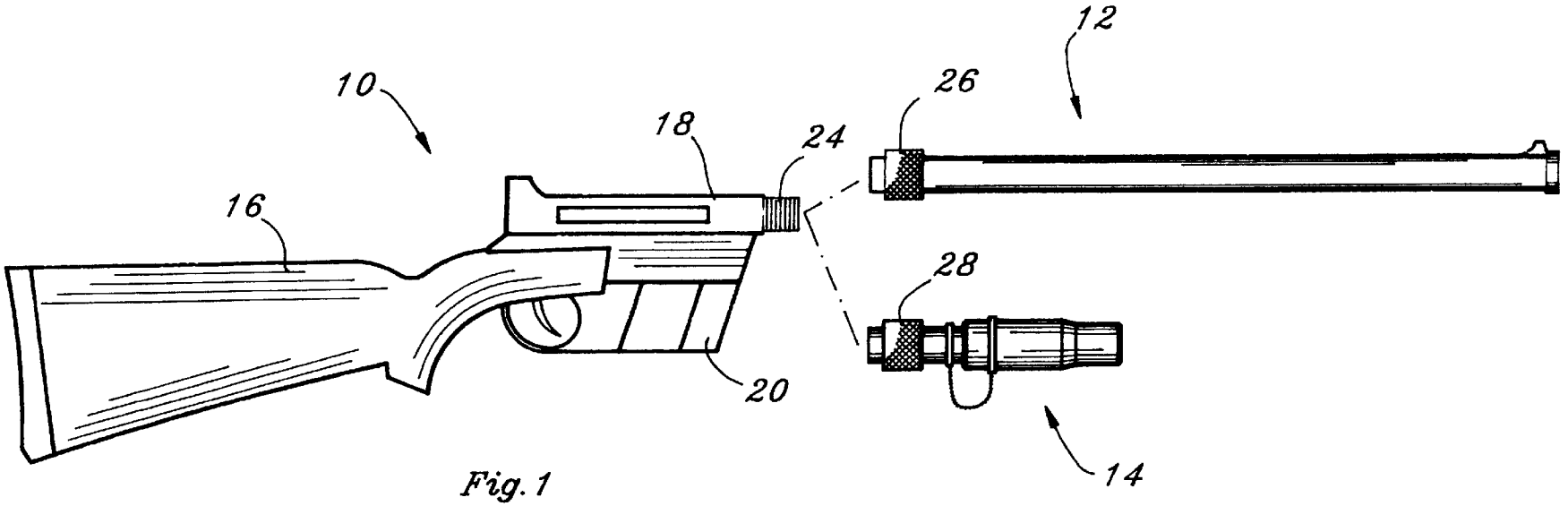

This invention generally relates to flare guns, and more particularly to an improved flare attachment designed to be used with a firearm with a removable barrel.

Flare guns are known to be used exclusively for signaling purposes by firing a cartridge similar to a 12-gauge shotgun cartridge to obtain a light signal or illumination for military or emergency purposes. Since the mechanism for firing a projectile and the mechanism for firing a flare cartridge is similar, firearms have been proposed which are adaptable to serve a dual purpose, so as to be used either as an offensive weapon or as a signaling device.

A firearm is disclosed in U.S. Pat. No. 4,648,192—Harness, in which a short barrel capable of firing flares is exchanged for another barrel capable of firing projectiles. Another proposal is disclosed in U.S. Pat. No. 5,148,620—Nelson, in which a shotgun shell adapter fits into the breech of a shotgun, enabling the gun to accept various sizes of cartridges. A particular difficulty results from providing a gun, which is capable of firing both center fire and rim fire cartridges. U.S. Pat. Nos 4,644,930—Mainhardt, discloses a gun capable of firing a variety of projectiles, both center fire and rim fire by employing various inserts.

All of the foregoing constructions employ complex mechanisms. It would be desirable to provide a simple and lightweight flare attachment designed to fit a firearm with a removable barrel, to be used in place of the projectile barrel for firing conventional signal flares. It would also be desirable to provide a flare attachment for a firearm with removable barrel, which can be attached in lieu of the barrel and provide further for rapid removal of spent flare cartridges and insertion of new flare cartridges.

Accordingly, one object of the present invention is to provide an improved flare attachment for a firearm with removable barrel.

Another object of the invention is to provide a simple and inexpensive flare attachment, which can be made primarily of plastic construction.

Still another object of the invention is to provide an improved and simple flare attachment with means to rapidly load and reload conventional flare cartridges.

SUMMARY OF THE INVENTION

Briefly stated, the invention comprises of a flare attachment for a firearm with a removable barrel, said firearm being of the type having a receiver with a bolt, cocking lever and recoil springs for actuating the firing pin, the receiver having an attachment end for receiving said removable barrel. The flare attachment comprises a firing pin housing having a central bore and including first attachment means arranged to attach the firing pin housing to the attachment end of said receiver, a flare cartridge barrel having a flare chamber shaped to receive a flare cartridge therein, and including second attachment means arranged for temporarily attaching the flare cartridge barrel to the firing pin housing so that the central bore is coaxial with the flare chamber. A firing pin extension as slidably disposed in the central bore having a first end for receiving impact from said bolt when the firing pin extension is in a first position and a second end for impacting a flare cartridge in said flare chamber when the firing pin extension slides to a second position. A retainer restricts the axial movement of the firing pin extension in the central bore, and a spring biases the firing pin extension away from the flare cartridge barrel to said first position, whereby the first end may receive an impact from said bolt.

In the preferred embodiment of the invention, the flare cartridge barrel and firing pin housing are manufactured of plastic and threaded together, having a lanyard connecting the two elements.

DRAWINGS

Figure 2:
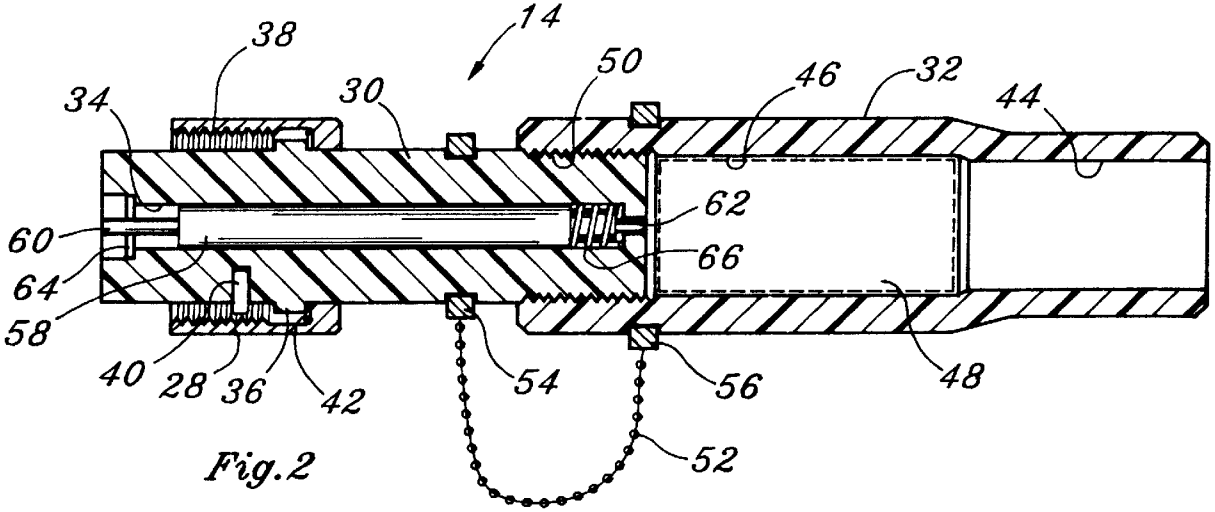
Figure 3:
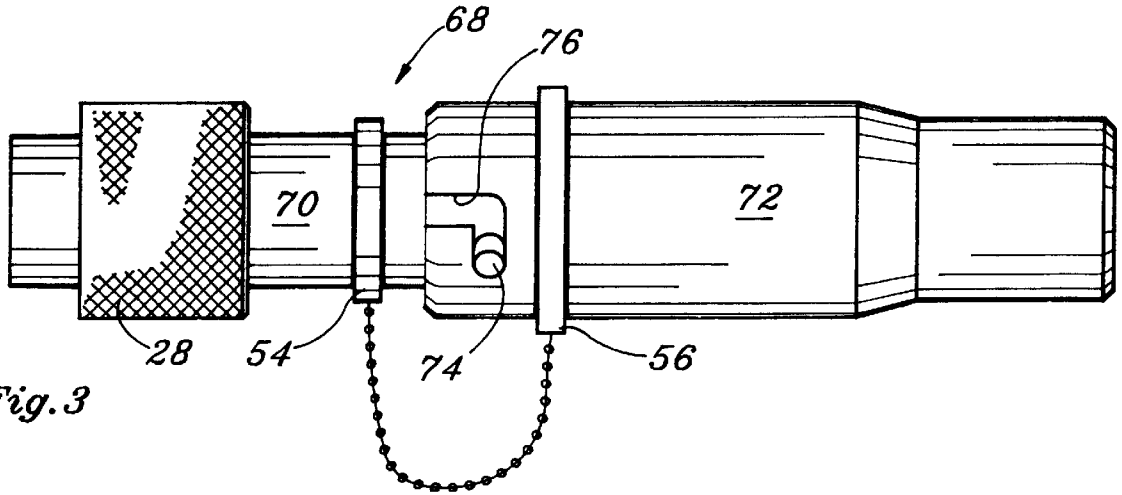
Figure 4:
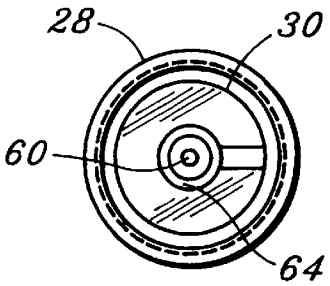

Other objects and advantages of the invention will be better understood by reference to the following drawings, taken in connection with the accompanying description, in which:

FIG. 1 is a side elevation view of a firearm with a removable barrel, shown removed, and illustrating also the flare attachment, FIG. 2 is a side elevational view in cross section of the flare attachment, FIG. 3 is a side elevational view of a modification of the flare attachment, and FIG. 4 is a rear-end view of the flare attachment shown in FIG. 2.

DESCRIPTION OF THE PREFERRED EMBODIMENT

Referring to FIG. 1 of the drawing, a firearm, shown generally as 10 is especially adapted to receive a removable barrel shown generally as 12 or, in lieu thereof, a flare attachment according to the present invention, shown generally as 14. A suitable firearm 10, together with a removable barrel 12 is commercially available under the trade name AR-7 from AR-7 Industries, LLC, Meriden, Conn. A similar firearm with removable barrel is available from Henry Repeating Arms, located in Brooklyn, N.Y. The distinctive feature of the AR-7 is that a receiver, barrel and magazine may all be disassembled stowed inside a hollow stock. This particular feature of the AR-7 is not relevant to the present invention, which can be used with any type of firearm having a removable barrel.

Referring to FIG. 1 of the drawing, firearm 10 includes a stock 16, a receiver 18, and cartridge magazine 20. Disposed inside receiver 18 is a bolt and recoil spring mechanism (not shown) actuatable by a cocking lever. The mechanism will vary according to the type of firearm. Construction of the bolt and recoil spring mechanism is not relevant to the present invention but well-known to those skilled in the art. Actuation of the cocking lever causes the bolt to travel along the central axis of a bore in the receiver 18 to impact the end of the cartridge in barrel 12. A firing pin may be designed to impact either a rim-fired cartridge or a central fired cartridge.

Receiver 18 includes a threaded end 24. Barrel 12 includes a barrel nut 26 with internal threads matching those of the threaded end 24. By unscrewing barrel nut 26, the barrel 12 may be easily and quickly removed from receiver 18.

Improved flare attachment 14 which is the object of the present invention is provided with a barrel nut 28 identical to the barrel nut 26 on the barrel, enabling the flare attachment 14 to be quickly and easily attached to or removed from threaded end 24 on receiver 18.

Referring now to FIGS. 2 and 4 of the drawing, the preferred version improved flare attachment 14 is shown in enlarged views. Details of flare attachment 14 are best seen in the cross-sectional drawing of FIG. 2. Flare attachment 14 includes two major separable parts, namely a firing pin housing 30 and a flare cartridge barrel 32. The firing pin housing is a longitudinal cylindrical member, preferably manufactured of high-impact plastic, defining a central bore 34 along its axis. The internally threaded barrel nut 28 is retained by flange 36 on the firing pin housing. An internal thread 38 matches the external threaded end 24 on the receiver of the firearm. A receiver locator pin 40 matches a slot (not shown) in the receiver 18 to prevent rotation of the housing 30 when the barrel nut 28 is tightened and held with a barrel nut lock washer 42.

Flare cartridge barrel 32 is also a cylindrical, longitudinal member with an internal bore 44 coaxial with central bore 34. A portion of bore 44 is shaped to provide a flare chamber 46 shaped to receive a conventional flare cartridge. Flare cartridge 48 is shown in dotted lines and is generally the shape of a short, 12-gauge shotgun shell.

The flare cartridge barrel 32 is also preferably made of the same plastic material as the firing pin housing 30 and the two are attached together by means of a threaded connection 50. The threaded connection 50 may alternately comprise an interrupted bayonet thread for rapid assembly and disassembly.

In order to prevent losing or dropping the flare cartridge barrel when it is removed for inserting a new cartridge 48, members 30 and 32 are connected by a lanyard 52, the ends of which are attached to rings 54, 56 disposed in angular grooves in the respective members 30, 32.

In order to fire the flare cartridge, a firing pin extension 58 is slidably disposed in the central bore 34. The firing pin extension 58 has a first end 60 for receiving impact from the bolt of the firearm when the firing pin is in a first position extending to the left, and a second end 62 for impacting the flare cartridge 48 in the flare chamber when the firing pin extension slides to a second position to the right. The firing pin extension 58 is shown in a second position in the FIG. 2 drawing. A firing pin retainer 64 in the end of the firing pin housing restricts the movement of the firing pin extension to the left in bore 34. A spring 66 biases the firing pin extension 58 toward the left side, or first position.

Modification

A modified form of the invention is shown in FIG. 3 as a flare attachment 68. Rather than a threaded connection 50, firing pin housing 70 and a flare cartridge barrel 72 are connected using a cam slot and radial pin arrangement. One or more radial pins 74 are arranged to project from a smooth cylindrical surface of firing pin housing 70 and one or more cam slots 76 are cut in the cylindrical wall of flare cartridge barrel 72. Other than this, there are no differences from flare attachment 14, shown in the cross-section of FIG. 2.

Operation

The invention operation follows:

Flare attachment 14 is screwed to the receiver 18 using the barrel nut 28. In order to insert a flare cartridge, the flare cartridge barrel 32 is unscrewed from the firing pin housing 30, rotation of the two members relative to one another being permitted by rotation of the rings 54, 56 on the respective members. A flare cartridge 48 is inserted into flare chamber 46 and the flare cartridge barrel 32 screwed back on to the firing pin housing 30. Actuation of the cocking lever causes the bolt in the firearm receiver 18 to impact the first end 60 of firing pin extension 58, where it is held biased to the left by spring 66. The impact causes firing pin extension 58 to travel to the right and the second end 62 to impact the primer of flare cartridge 48, firing the flare from bore 44. Removal of the spent cartridge and insertion of a new cartridge proceeds in the same manner.

Equivalent constructions to the threaded connection 50 are well-known in the art. As mentioned previously, the threaded connection may be an interrupted bayonet type thread. Alternatively, one or more cam slots may be provided in the flare cartridge barrel 32 which mate with pins mounted radially in the firing pin housing 30, as shown in FIG. 3.

By constructing the flare attachment 14 of plastic material, a less expensive construction is obtained, since the larger components of the flare attachment can be made by injection molding to reduce the cost.

While a barrel nut is shown as a means of attachment to the firearm, any type of attachment may be employed which corresponds to the attachment used on the removal barrel of the selected firearm.

While there has been described what is considered to be the preferred embodiment of the invention, other modifications will occur to those skilled in the art, and it is desired to secure in the appended claims all such modifications as fall within the true spirit and scope of the invention.

What is claimed as new is:

1. Flare attachment for a firearm with a removable barrel, said firearm being of the type having a receiver with bolt and cocking lever mechanism for actuating the firing pin, said receiver having an attachment end for receiving said removable barrel, the flare attachment comprising:

a firing pin housing having a central bore and including first attachment means arranged to attach said firing pin housing to said attachment end of said receiver, a flare cartridge barrel having a flare chamber shaped to receive a flare cartridge therein, and including second attachment means arranged for temporarily attaching the flare cartridge barrel to the firing pin housing so that the central bore is coaxial with the flare chamber, a firing pin extension slidably disposed in the central bore, said firing pin extension having a first end for receiving impact from said bolt when the firing pin extension is in a first position and a second end for impacting a flare cartridge in said flare chamber when the firing pin extension slides to a second position, retainer means restricting the axial movement of the firing pin extension in the central bore, and spring means biasing the firing pin extension away from the flare cartridge barrel to said first position whereby the first end may receive an impact from said firing pin.

2. The combination according to claim 1, wherein the first attachment means comprises a barrel nut having internal threads adapted to fit the attachment end of said receiver.

3. The combination according to claim 1, wherein said second attachment means comprises matching threads on the firing pin housing and on the flare cartridge barrel.

4. The combination according to claim 1, wherein said second attachment comprises at least one slot in the flare cartridge barrel and at least one radial pin extending from the firing pin housing, said radial pin being arranged to slide in the cam slot.

5. The combination according to claim 1, wherein said flare cartridge barrel and said firing pin housing are constructed of plastic material.

6. The combination according to claim 1, and further including a lanyard connecting the firing pin housing to the flare cartridge barrel.

7. The combination according to claim 6, and further including at least one annular ring attached to said lanyard and encircling portions of the flare attachment so as to provide relative rotation between the flare cartridge barrel and the firing pin housing.

* * * * *